United States Patent [19]

Hjerl

[11] 4,233,688

[45] Nov. 18, 1980

[54] BIB

[76] Inventor: Jonna Hjerl, Freltoftevej 22, DK-5653 near Lyndelse, Denmark

[21] Appl. No.: 2,057

[22] Filed: Jan. 9, 1979

[51] Int. Cl.[3] ..... A41B 13/10

[52] U.S. Cl. ..... 2/49 R

[58] Field of Search ..... 2/49 R, 48, 50, 51, 2/52

[56] References Cited

U.S. PATENT DOCUMENTS

| | | | |
|---|---|---|---|
| 3,001,646 | 9/1961 | Cooper | 2/49 R |
| 3,146,464 | 9/1964 | Burnett | 2/49 R |
| 3,299,440 | 1/1967 | Grable | 2/49 R |
| 3,332,547 | 7/1967 | Rowe et al. | 2/49 R |
| 3,583,558 | 6/1971 | Davis | 2/49 R |
| 3,619,816 | 11/1971 | Cowen | 2/49 R |
| 3,851,336 | 12/1974 | Hjerl | 2/49 R |
| 3,945,048 | 3/1979 | Shearer | 2/49 R |

*Primary Examiner*—Doris L. Troutman

*Attorney, Agent, or Firm*—Ladas & Parry

[57] ABSTRACT

The invention relates to a bib made of sheet material such as paper and by which a substantially rectangular sheet is provided with a rupture line along a neckline cutout in order to allow the user of such a bib to remove the part of the sheet inside said rupture line in direct connection with the use of the bib and thereby having right at hand said removed part of the sheet which may be used as a handkerchief or for other appropriate purposes.

1 Claim, 1 Drawing Figure

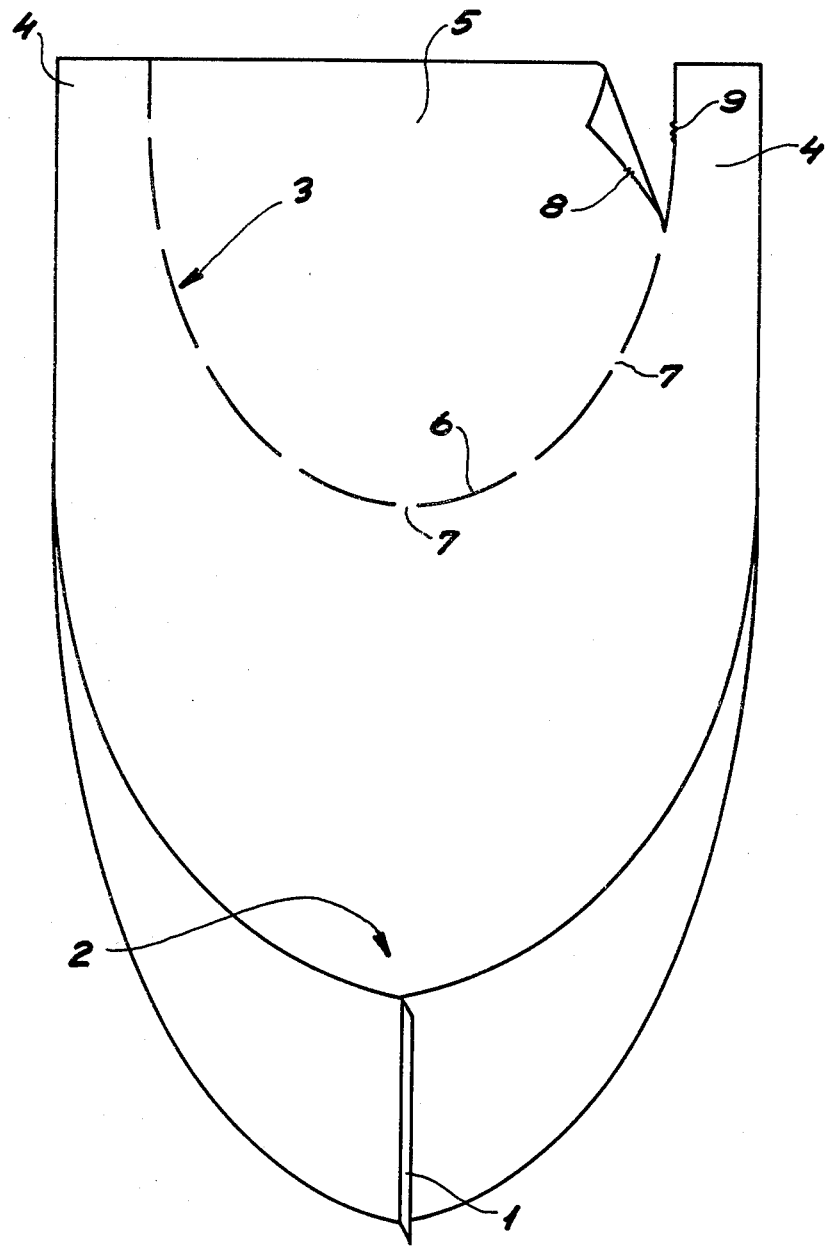
4
5
9
4
3
8
7
6
7
2
1

BIB

This invention relates to a bib formed from a substantially rectangular soft sheet material and provided with a neckline cutout at one end thereof. Such a bib could be made of soft and reinforced paper material and the invention has for its purpose to show a bib by which the neckline cutout is produced by means of a rupture line whereby the part of the sheet material within the neckline may easily be removed from the bib when this has to be used and the removed material can then be used as a handkerchief being easily at hand for a person who is going f. inst. to feed a baby. Thus, there will be no waste of material and the bib is very practical in use.

In a preferred embodiment of such a bib, it is provided with a pocket formed at the end opposite the neckline cutout and said pocket is performed by joining together two halves of the edge portion f. inst. by gluing or in any other appropriate manner.

Further details concerning the invention will appear in the following specification with the reference to the accompanying drawing, which shows in perspective view a bib according to the invention.

In the drawing is shown a bib made from a substantially rectangular piece of soft sheet material, f. inst. paper having a sufficient mechanical strength and moisture resistancy and at one end thereof, the two halves of the edge are joined together forming a seam 1 said joining being preferably made by gluing. Thereby a pocket 2 is formed at the lower end of the bib.

At the upper end of the rectangular sheet a rupture line 3 is performed, thereby defining a neckline cutout having further two narrow strips 4 by which the bib may be attached to a baby. The part 5 of the sheet material positioned within the rupture line 3 may thus be removed from the bib itself in direct connection with the use of the bib, and the rupture line may be cut out in any suitable manner, f. inst. as a weakening line or a perforation line or as shown in the FIGURE by through cut 6 interrupted by narrow non-cut portions 7. In the drawing it is shown how the part 5 may be removed from the bib by breaking the non-cut parts 7 thereby forming small frazzled parts 8 and 9 along the edge of the part 5 and along the neckline cutout respectively.

What I claim is:

1. A bib formed from a substantially rectangular soft sheet material and having a pocket at one end and wherein at the other end of the sheet a single rupture line defines a narrow tie-strip at each side edge of the sheet and further defines a neck-line cutout, the sheet material inside said neckline cutout forming a napkin bounded by the end edge of the sheet and totally removable from the bib along said rupture line.

* * * * *